US006231376B1

(12) United States Patent
Kuo

(10) Patent No.: US 6,231,376 B1
(45) Date of Patent: May 15, 2001

(54) CABLE END CONNECTOR HAVING RETENTION MEANS FOR A CABLE ATTACHED THERETO

(75) Inventor: Chin Pao Kuo, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/473,453

(22) Filed: Dec. 28, 1999

(51) Int. Cl.[7] ..... H01R 13/58
(52) U.S. Cl. ..... 439/457
(58) Field of Search ..... 439/456–459, 439/573

(56) References Cited

U.S. PATENT DOCUMENTS 5,380,220 * 1/1995 Okabe ..... 439/456
5,616,052 * 4/1997 Pan et al. ..... 439/573
5,803,766 * 9/1998 Yang ..... 439/573
5,848,916 * 12/1998 Huang ..... 439/457

* cited by examiner

*Primary Examiner*—Gary F. Paumen
(74) *Attorney, Agent, or Firm*—Wei Te Chung

(57) ABSTRACT

A cable end connector comprises an electrical connector part and a signal transmission cable attached to the electrical connector part. The electrical connector part comprises an over-mold and a mating portion receiving a plurality of terminals and extending from the over-mold. The over-mold defines a notch in an upper portion thereof which comprises a pair of integrally formed opposing latching blocks in an inside surface thereof. The cable is disposed in the notch and securely latched by the pair of latching blocks, thereby the cable being maintained in the notch at a right angle configuration.

1 Claim, 2 Drawing Sheets

CABLE END CONNECTOR HAVING RETENTION MEANS FOR A CABLE ATTACHED THERETO

BACKGROUND OF THE INVENTION

The present invention relates to a cable end connector, and particularly to a cable end connector having means for securely retaining a cable thereof.

A conventional cable end connector comprises an electrical part having an over-mold, a plug portion depending from the electrical part and receiving a plurality of terminals and a signal transmission cable electrically fixed to electrical part for terminating to another mating connector, such as a universal serial bus (USB) connector. The transmission cable always needs to be firstly rotated through a predetermined angle with respect to the electrical part and then is retained in a recess defined in the over-mold by gluewater. Even this is a simple way, but the fixing force is not sufficient for securely retaining the transmission cable in the recess and a worker must wait for the gluewater to become completely cured before operating a next procedure, so this is both laborious and cost-ineffective. Additionally, the gluewater may overflow out of the recess if the worker is not careful enough, thereby adversely affecting the appearance of the cable end connector.

Hence, an improved fixing means for the transmission cable is required to overcome the disadvantages of the prior art.

BRIEF SUMMARY OF THE INVENTION

An essential object of the present invention is to provide cable end connector having securing means for securely retaining a cable to an electrical part thereof and reducing the man-hour of the manufacture of the cable end connector.

A cable end connector in accordance with the present invention comprises an electrical connector part and a signal transmission cable attached to the electrical connector part. The electrical connector part comprises an over-mold and a mating portion receiving a plurality of terminals and extending from the over-mold. The over-mold defines a notch in an upper portion thereof which comprises a pair of integrally formed opposing latching blocks in an inside surface thereof. The cable is disposed in the notch and securely latched by the pair of latching blocks, thereby the cable being maintained in the notch at a right angle configuration.

Other objects, advantages and novel features of the invention will become more apparent from the following detailed description of the present embodiment when taken in conjunction with the accompanying drawings.

DETAILED DESCRIPTION OF THE INVENTION

Figure 1:
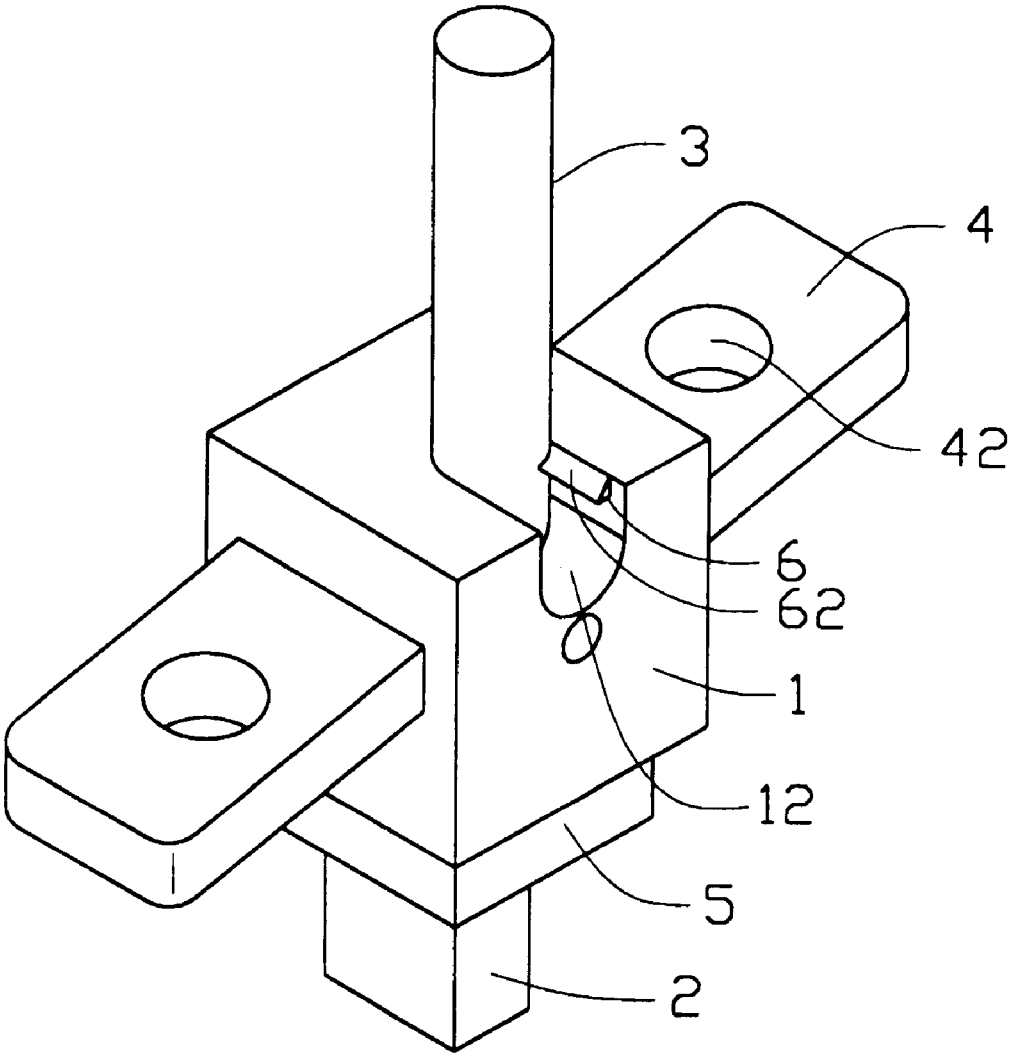
FIG. 1 is a perspective view of a cable end connector assembly the present invention with a signal transmission cable thereof retained in a first place

Referring to FIG. 1, a cable end connector of the present invention mainly comprises a rectangular-shaped electrical connector part which is insert molded with plastic and a signal transmission cable 3 attached thereto. The electrical connector part comprises an over-mold 1, a mating portion

2 depending therefrom and a shoulder 5 depending from the over-mold 1 and partially enclosing the mating portion 2. A pair of planar side wings 4 are formed at opposite sides of the over-mold 1, one extending laterally and downwardly while the other extending laterally and upwardly. The pair of side wings 4 define a pair of threaded holes 42 in substantially mediums thereof to engage with a pair of bolts (not shown) to fix the cable end connector to a receptacle case (not shown). The cable 3 is fixed to the over-mold 1 and comprises an outer jacket (not labeled) which is made up of raw plastic material and thus is flexible.

Figure 2:
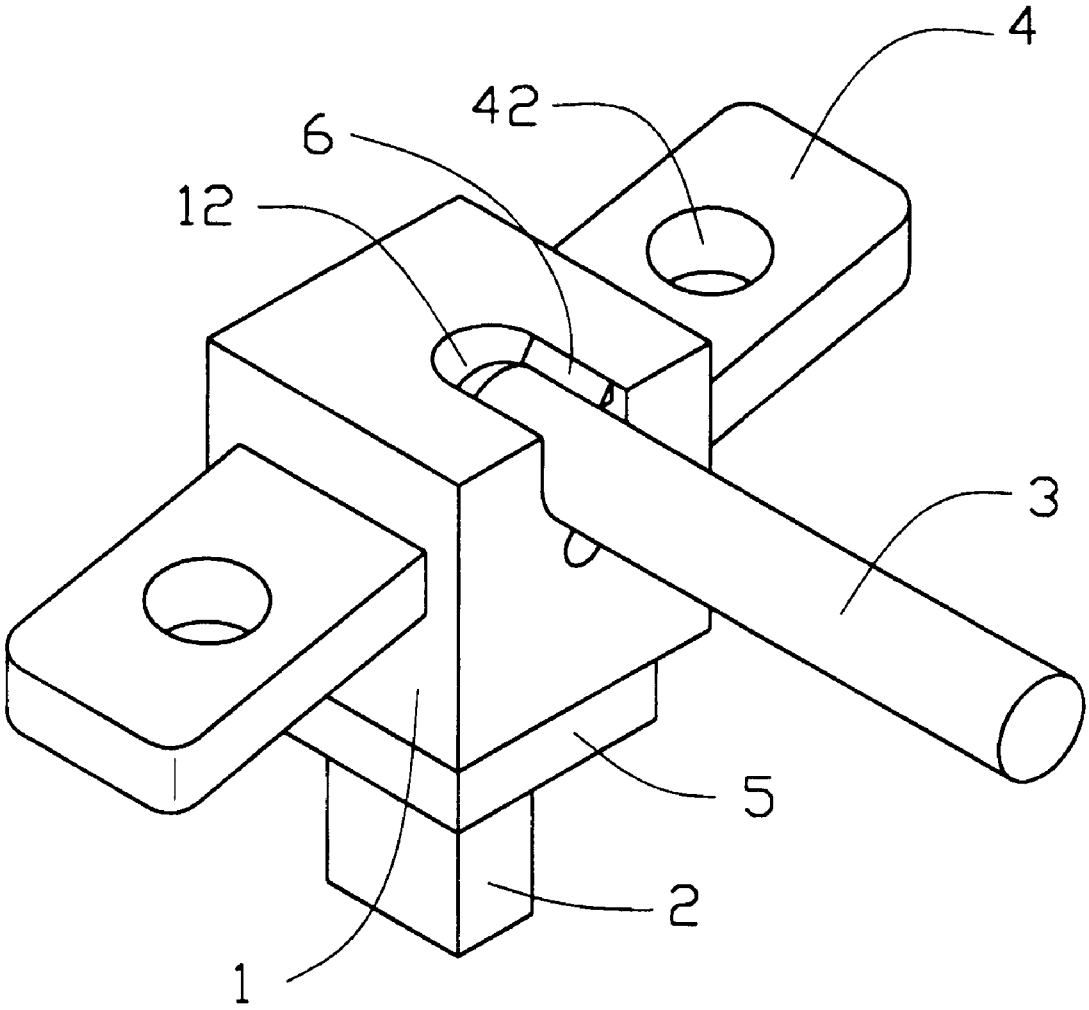
FIG. 2 is a perspective view of FIG.1 with the signal transmission cable thereof retained in a second place.

Referring to FIGS. 1 and 2, an enlarged notch 12 is defined at a rear end of a top portion of the over-mold 1, which is a semi-cylinder shape for receiving the signal transmission cable 3. A pair of opposing latching blocks 6 are integrally formed in a rear end of the elongate notch 12 for latching the signal transmission cable 3. The pair of latching blocks 6 extend from an inside surface of the notch 12, and each is an elongated triangle shape and forms a slopped top surface 62 to facilitate an insertion of the cable 3 into the notch 12.

In assembly, referring to FIG. 1, the signal transmission cable 3 is first vertically connected in the notch 12 of the over-mold 1 and is retained by the pair of front surfaces (not shown) of the latching blocks 6. Before terminating to another mating connector, the cable 3 rotates substantially a right angle with respect to the over-mold 1 and is then pushed into the receiving latch 12 because of the outer jacket 32 of the cable 3 being flexible, sliding through the pair of slopped surfaces 62 of the latching blocks 6 and tightly clawed by the pair of latching blocks 6. Obviously, the fixing means of the cable of the present invention is more safely, the man-time is shorter and can not adversely affecting the appearance of the cable end connector compared with the conventional cable end connector which fixes the cable to the over-mold thereof by gluewater.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an electrical connector part including an over-mold and a mating portion extending in a first direction on one side thereof, said over-mold defining a notch on the other side thereof, said notch extending along a second direction perpendicular to said first direction, a pair of opposing, sloping blocks extending in said notch along said second direction; and a cable initially connected to the over-mold and extending partially in said notch in a third direction opposite to said first direction, and then bent at an right angle to be retainably received by said blocks within and extend along the notch;

wherein a pair of wings generally extend outwardly at two sides of the over-mold perpendicularly to the second direction, one of said pair of wings extends laterally and downwardly while the other pair of wings extends laterally and upwardly, and each of said pair of wings has a threaded hole therein for securing the connector part to a receptacle case.

* * * * *